United States Patent [19]

Takayama et al.

[11] Patent Number: 4,713,588

[45] Date of Patent: Dec. 15, 1987

[54] IMAGE PICKUP TUBE

[75] Inventors: Shigehiko Takayama, Mitaka; Hitomi Suzuki, Akishima; Masanori Maruyama, Kokubunji; Masakazu Fukushima, Tokyo; Mitsuhiro Kurashige, Tachikawa, all of Japan

[73] Assignees: Hitachi, Ltd.; Nippon Hoso Kyokai, both of Tokyo, Japan

[21] Appl. No.: 849,832

[22] Filed: Apr. 9, 1986

[30] Foreign Application Priority Data

Apr. 10, 1985 [JP] Japan ..... 60-74287

[51] Int. Cl.[4] ..... H01J 29/58

[52] U.S. Cl. ..... 315/382; 313/389

[58] Field of Search ..... 315/382, 17; 335/213; 313/389, 434

[56] References Cited

U.S. PATENT DOCUMENTS

| | | | |
|---|---|---|---|
| 3,319,110 | 5/1967 | Schlesinger | 313/389 |
| 3,919,597 | 11/1975 | Meacham | 315/382 |
| 3,952,227 | 4/1976 | Van Alphen | 315/382 |
| 4,382,213 | 5/1983 | Kajimura et al. | 315/382 |
| 4,527,846 | 7/1985 | Hertel | 315/382 |

FOREIGN PATENT DOCUMENTS

| | | | |
|---|---|---|---|
| 2315784 | 3/1973 | Fed. Rep. of Germany | 313/389 |
| 56-114620 | 9/1981 | Japan | 313/389 |

*Primary Examiner*—Theodore M. Blum
*Assistant Examiner*—David Cain
*Attorney, Agent, or Firm*—Antonelli, Terry & Wands

[57] ABSTRACT

A magnetic-focus electrostatic-deflection image pickup tube utilizes a magnetic field for electron beam focusing and an electrostatic field for electron beam deflection. The magnetic field generated by a magnetic focus coil is distributed on the tube axis to have the peak of intensity which is offset toward the electron gun. The electron beam can be deflected and focused to provide a minimized beam spot with less distortion.

5 Claims, 15 Drawing Figures

$AT_2/AT_1 = 1.0$ $AT_2/AT_1 = 1.5$
$l_2/l_1 = 1$ $AT_2/AT_1 = 3.0$
$l_2/l_1 = 1$ $AT_2/AT_1 = 1.5$
$l_2/l_1 = 1/2$ $AT_2/AT_1 = 3.0$
$l_2/l_1 = 1/2$

IMAGE PICKUP TUBE

BACKGROUND OF THE INVENTION

This invention relates to a magnetic-focus electrostatic-deflection system for an image pickup tube and especially to improvements in its characteristics.

As one of the types of focus and deflection schemes for image pickup tubes, a so-called magnetic-focus electrostatic-deflection system (hereinafter simply referred to as an MS system) has been known which utilizes a magnetic field for beam focusing and an electrostatic field for beam deflection. The structure of this system for an image pickup tube is described in detail by, for example, in U.S. Pat. No. 3,319,110, May 9, 1967 and U.S. Pat. No. 3,796,910, May 12, 1974.

A specific construction of a prior art MS image pickup tube is illustrated in FIG. 1. Referring to FIG. 1, electrostatic deflection electrodes 1 in the form of quadrupole electrodes are adapted to produce uniform deflection fields in horizontal and vertical directions. The electrostatic deflection electrodes 1 are in close contact with the inner surface of a tube 2. Near one end (rear) of the image pickup tube, an electron gun 3 for generation of an electron beam is placed and at the other end (front), a photoconductive target 5 is formed on a faceplate and a mesh electrode 4 is supported in spaced relationship to the photoconductive target 5. These components are all housed in the tube 2. A focus coil 7 surrounds the tube 2 and generates a magnetic field for focusing the electron beam.

The unrolled deflection electrodes seen from the inside of the electrodes are shown in FIG. 2. Zigzag-shaped electrodes were invented by K. Schlesinger (U.S. Pat. No. 2,681,426, June 15, 1954) and were referred to as the curved arrow pattern yoke. The shapes of the electrodes are sometimes modified by twisting them about the axis of the tube to reduce raster distortion and improve deflection sensitivity (for example, see FIG. 3 of U.S. Pat. No. 3,666,985, May 30, 1972).

The twist angle $\omega$ is indicated in the FIG. 2. The pitch of the deflection electrodes is $L_0$ and the number of the repetitions is N. The total length of the deflection electrodes is $NL_0$. The positive Z direction is taken to be the direction in which undeflected electrons travel. The $\theta$ direction is the circular direction around the axis Z of the tube. ($V^+$, $V^-$) and ($H^+$, $H^-$) are the vertical and horizontal deflection electrodes respectively. This MS image pickup tube is said to be advantageous in that theoretically, uniform resolution can be obtained over the beam scanning area and distortion can be minimized.

In practical image pickup tubes, however, the electrode of the electron gun 3 is so constructed that a region extending across an interval $L_1$ between an aperture 6 and the fore end of the electron gun electrode 3 is shielded from the electrostatic deflection field generated by the electrostatic deflection electrode 1, as shown in FIG. 1. Consequently the electrostatic deflection field is almost zero in the region. The electrostatic deflection field is also almost zero in a region extending across an interval $L_3$ between the fore end of the electrostatic deflect-on electrode 1 and the mesh electrode 4. Further, in a region extending across an interval $L_4$ between the mesh electrode 4 and the photoconductive target 5, there occurs only a strong electrostatic deceleration field $E_Z$ and no electrostatic deflection field exists.

On the other hand, because of a finite length of the focus coil 7, a magnetic field produced thereby is not constant and uniform on the tube axis but is distributed as shown in FIG. 3 to approximate a Gaussian distribution.

Hence, the MS image pickup tube exhibits deflection aberrations and landing error due to the lack of uniformity of the electromagnetic field.

Accordingly, the practical image pickup tube encounters a problem that when the electron beam is deflected, the beam spot size becomes larger and raster distortion exists.

SUMMARY OF THE INVENTION

An object of the present invention is to provide an MS image pickup tube which can minimize the spot size of the deflected beam and suppress the raster distortion.

To accomplish the above object, according to this invention, an MS image pickup tube has a focus coil for generating a magnetic focus field which has an asymmetrical distribution of intensity in the tube axis direction such that the intensity is greater toward the electron gun than toward the target.

DESCRIPTION OF THE PREFERRED EMBODIMENT

Figure 1:
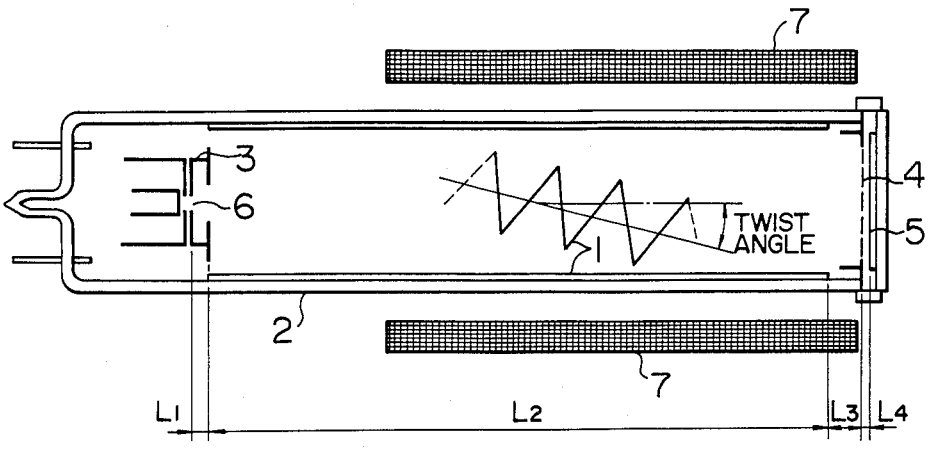
FIG. 1 PRIOR ART
FIG. 1 is a sectional view showing a prior art MS image pickup tube.
Figure 2:
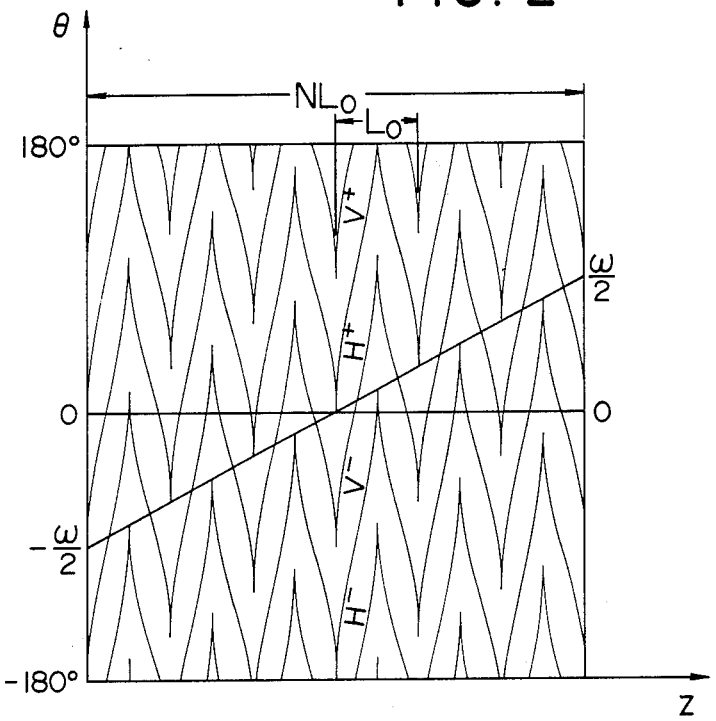
FIG. 2 shows the unrolled deflection electrodes which contains a twist along the axis of the tube.
Figure 3:
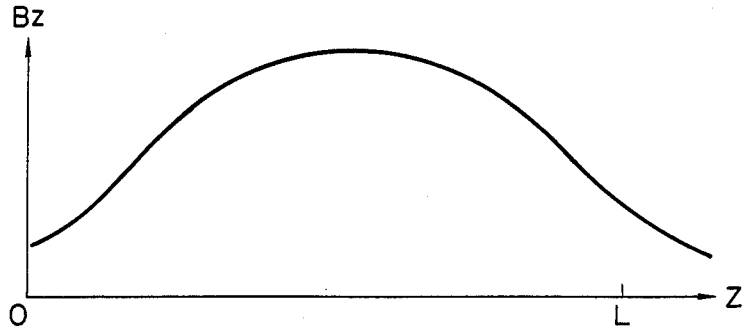
FIG. 3 is a graph showing an on-axis magnetic field distribution inside the practical image pickup tube.
Figure 4:
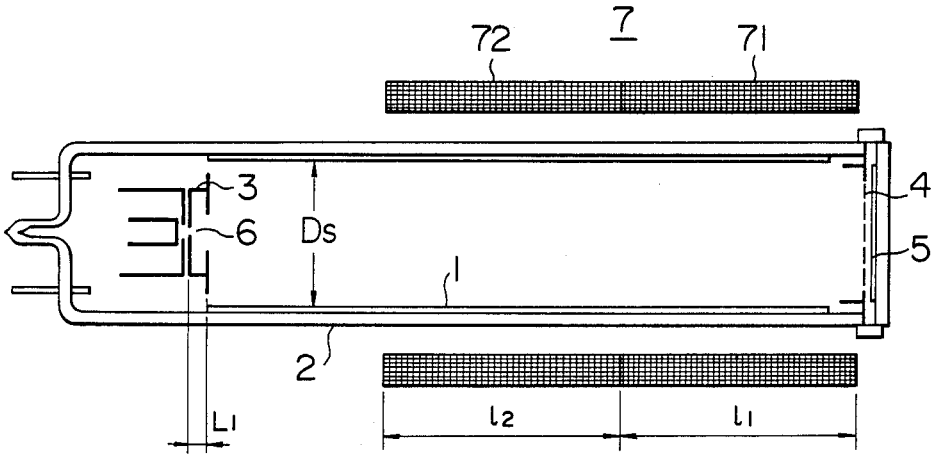
FIG. 4 is a sectional view showing an image pickup tube according to an embodiment of the invention.

A preferred embodiment of an MS type image pickup tube according to the invention will now be described with reference to FIG. 4 in which identical parts to those of FIG. 1 are designated by identical reference numerals and will not be described herein. The electrostatic deflection electrodes 1 have axial length $L_2$ of 60.0 mm and an inner diameter $D_S$ of 23.9 mm. The interval $L_1$ between an aperture 6 of an electron gun 3 and the fore end of the electron gun electrode is 2.2 mm, the axial distance between the aperture 6 and the surface of mesh electrode 4 close to the photoconductive target 5 is 68.2 mm, and the gap between the electrostatic deflection electrode 1 and the mesh electrode 4 is 1.0 mm. The interval $L_4$ between the surface of the mesh electrode 4 close to the target and the target 5 is 2.5 mm.

The number N of the repetitions in the deflection electrodes is 10 and the pitch $L_0$ is 6 mm.

The scanning area of the electron beam on the photoconductive target is a rectangle whose vertical and horizontal length are 9.5 and 12.7 mm respectively.

For example, the voltage $E_{c2}$ of 20 V is applied to the electron gun 3 and the voltage $E_T$ of 50 V to the photoconductive target 5. The electrostatic deflection electrode 1 is applied with the DC voltage $E_{c3}$ of 300 V. An electrostatic field, which is generated by a potential difference between the DC voltage of the electrostatic deflection electrode 1 and a voltage $E_{c4}$ applied to the mesh electrode 4, forms a collimating lens which eliminates the radial component of the velocity of deflected electrons at the target by adjusting the voltage $E_{c4}$ of the mesh electrode. Since the magnetic focus field generated by a focus coil system 7 causes the beam to rotate during the deflection, the electrons at the target have a tangential ($\theta$direction) component of the velocity and this component differs as the focus magnetic field differs. The twist in the deflection electrodes is also utilized to eliminate the tangential component of the velocity of deflected electrons at the target by adjusting the twist angle $\omega$. Thus, the voltage $E_{c4}$ of the mesh electrode cooperates with the twist angle $\omega$ of the electrostatic deflection electrodes to permit vertical landing of the deflected beam on the target.

The focus coil system 7 has an axial center which is 42.0 mm distant from the aperture 6 and its axial total length is constant, measuring 56.0 mm.

The focus coil system 7 is divided into two coils in the direction of the tube axis. A first coil 71 close to the photoconductive target 5 has a length $l_1$ and an ampere-turn of $AT_1$, and a second coil 72 close to the electron gun 3 has a length $l_2$ and an ampere-turn of $AT_2$.

Figure 5:
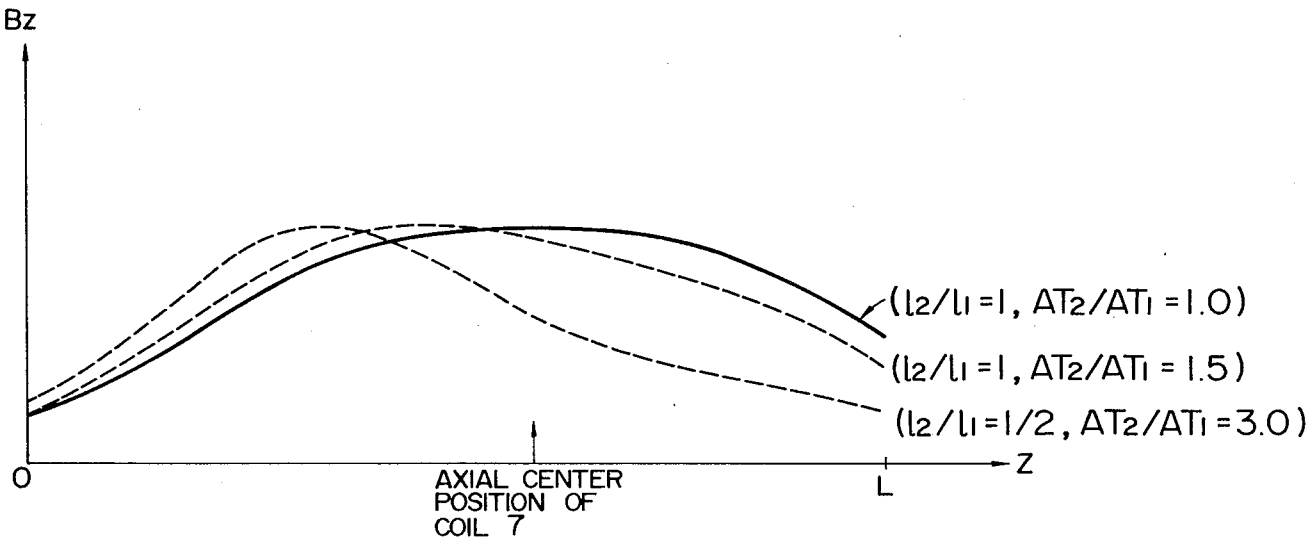
FIG. 5 is a graphical representation showing different on-axis magnetic field distributions inside the image pickup tube according to the invention.

By varying a ratio $l_2/l_1$ between lengths of the second and first coils 72 and 71 and a ratio $AT_2/AT_1$ between ampere-turns of the coils 72 and 71, the magnetic field generated by the focus coil system 7 can have various distributions on the tube axis as shown in FIG. 5. It will be appreciated that a magnetic fieled distribution (dotted-line curve) for $l_2/l_1=\frac{1}{2}$ and $AT_2/AT_1=3.0$ is greatly offset toward the electron gun as compared to a magnetic field distribution (solid-line curve) for $l_2/l_1=1$ and $AT_2/AT_1=1.0$ which is attributable to the undivided coil as shown in FIG. 1. When the total length of the focus coil system 7 is normalized to 1 (one), the peak of an on-axis magnetic fieled distribution (dotted-line curve) for $l_2/l_1=1$ and $AT_2/AT_1=1.5$ is about 1/6 distant from the axial center position of focus coil system 7 toward the electron gun 3, and the on-axis magnetic field distribution for $l_2/l_1=\frac{1}{2}$ and $AT_2/AT_1=3.0$ is about $\frac{1}{3}$ distant from the axial center position.

Figure 6:
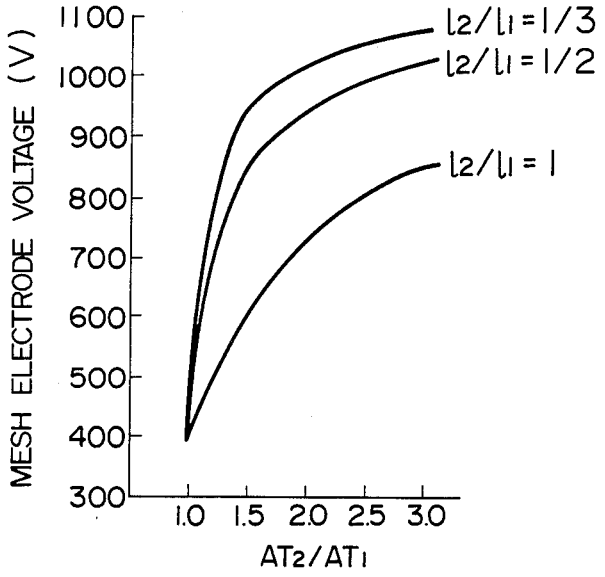
FIG. 6 is a graph showing mesh electrode voltages required for a deflected beam to land on the target vertically to the surface thereof.
Figure 7:
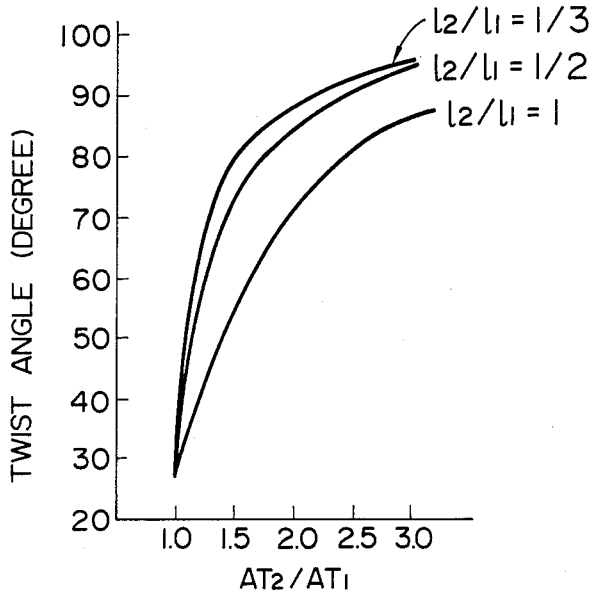
FIG. 7 is a graph showing twist angles required for the same condition as in FIG. 6.

As the ampere-turn ratio $AT_2/AT_1$ is varied as described above, the voltage of mesh electrode 4 necessary for the vertical impingement of the deflected beam on the target 5 also varies as shown in FIG. 6. In addition, the twist angle of the electrostatic deflection electrode 1 twisted about the tube axis, which is also necessary for the vertical impingement of the deflected beam, varies as shown in FIG. 7. In these figures, the length ratio $l_2/l_1$ is a parameter.

FIGS. 6 and 7 both tell that the greater the deviations of values of $l_2/l_1$ or $AT_2/AT_1$ becomes, the greater the necessary values of the mesh electrode voltage and twist angle become.

Within a range of from $AT_2/AT_1=1.5$ to $AT_2/AT_1=3.0$, the twist angle varies from 54° for $l_2/l_1=1$ to 95° for $l_2/l_1=\frac{1}{3}$.

Figure 8:
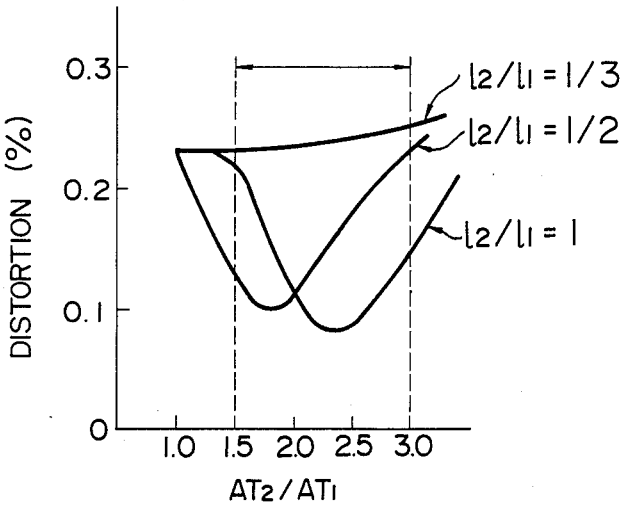
FIGS. 8 to 10 are graphical representations showing analytical results of characteristics of the image pickup tube according to the invention.
Figure 9:
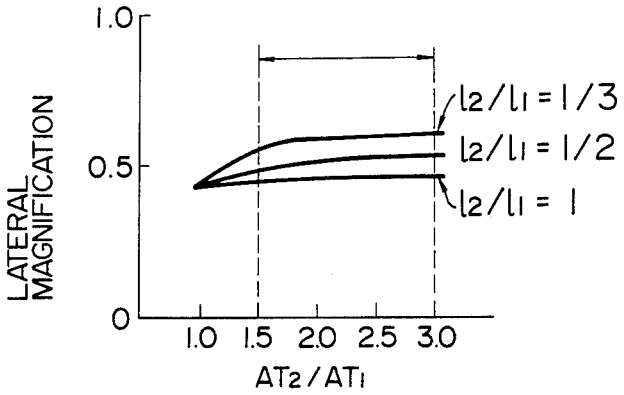
Figure 10:
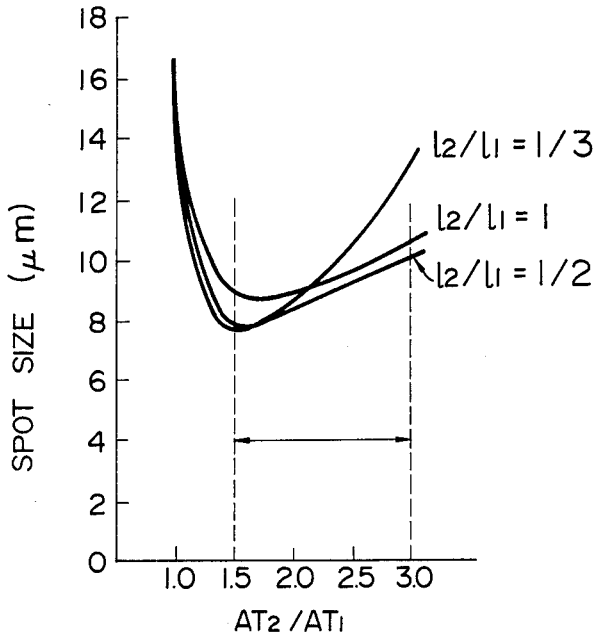
Figure 11A:
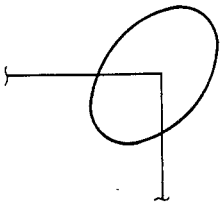
FIGS. 11*a* to 11*e* illustrates various spots for explaining effects obtained by the invention.
Figure 11B:
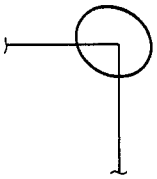
Figure 11C:
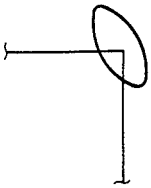
Figure 11D:
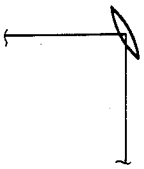
Figure 11E:
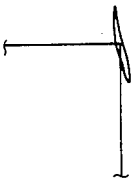

Using the length ratio $l_2/l_1$ as a parameter FIGS. 8 to 10 illustrate the relation of various characteristics to the ampere-turn ratio $AT_2/AT_1$ which is determined through computer simulation. Irrespective of values of $l_2/l_1$, values of the characteristics at $AT_2/AT_1=1.0$ are identical to those for the case where the focus coil is undivided to provide the on-axis magnetic field distribution which is not offset (the solid-line curve in FIG. 5).

Specifically, FIG. 8 illustrates the relation between distortion and $AT_2/AT_1$. It will be seen from FIG. 8 that within a range of from $AT_2/AT_1=1.5$ to $AT_2/AT_1=3.0$, distortions for $l_2/l_1=1$ and $l_2/l_1=\frac{1}{2}$ can be reduced to half or less in comparison with the distortion for $l_2/l_1=1$ and $AT_2/AT_1=1.0$ which define the undivided coil. The distortion for $l_2/l_1=\frac{1}{3}$, however, can not be decreased below the distortion for the undivided coil even when $AT_2/AT_1$ is varied.

FIG. 9 illustrates the relation between lateral magnification and $AT_2/AT_1$. Since the mesh electrode voltage is varied as shown in FIG. 6, the lateral magnification remains almost unchanged even when $AT_2/AT_1$ is varied. However, as the ampere-turn ratio $AT_2/AT_1$ increases, the lateral magnification for $l_2/l_1=\frac{1}{3}$ increases greatly when compared to the lateral magnification for $l_2/l_1=1$ and $AT_2/AT_1=1.0$ which define the undivided coil, resulting in an increased spot size at the center of screen.

FIG. 10 illustrates the relation between the maximum spot size of the deflected beam at the corner of the scanning area and the ampere-turn ratio $AT_2/AT_1$. Within a range of from $AT_2/AT_1=1.5$ to $AT_2/AT_1=3.0$, the maximum spot sizes for $l_2/l_1=1$ and $l_2/l_1=\frac{1}{2}$ can be reduced to approximately half the maximum spot size for $l_2/l_1$ and $AT_2/AT_1=1$ which define the undivided coil. The spot size for $l_2/l_1=\frac{1}{3}$ can also be reduced to approximately half the spot size for the undivided coil at $AT_2/AT_1=1.5$ but it increases at a higher rate as the ampere-turn ratio $AT_2/AT_1$ increases.

FIGS. 11*a* to 11*e* illustrate various spot forms of the deflected beam at the corner of the scanning area. It will be appreciated from these figures that within a range of from $AT_2/AT_1=1.5$ to $AT_2/AT_1=3.0$ the spot sizes for $l_2/l_1=1$ and $l_2/l_1=\frac{1}{2}$ (FIGS. 11*b* to 11*e*) can be reduced below the spot size for $AT_2/AT_1=1.0$ (FIG. 11*a*) which defines the undivided coil. Especially, the spot size for $l_2/l_1=1$ and $AT_2/AT_1=1.5$ (FIG. 11*b*) has a minimal form with good circularity, with which uniformity of resolution over the scanning area can be improved greatly.

As will be seen from the foregoing description, in order to minimize the distortion and spot size of the deflected beam, it is preferable that for the length ratio $l_2/l_1$ of $\frac{1}{2}$ to 1, the ampere-turn ratio $AT_2/AT_1$ be set to range from 1.5 to 3.0. Under this condition, where the total length of the focus coil 7 is normalized to 1 (one) as shown in FIG. 5, the peak of intensity distribution of the on-axis magnetic field falls within a range which covers distances of 1/6 to $\frac{1}{3}$ from the axial center of the focus coil 7 toward the electron gun 3; at the same time, the twist angle of the electrostatic deflection electrode 1 twisted about the tube axis varies from 54° to 95° as shown in FIG. 7.

As described above, according to the previous embodiment of the invention, by dividing the focus coil into two coils, setting the length of the second coil close to the electron gun to be 0.5 to 1.0 times the length of the first coil close to the photoconductive target and setting the ampere-turn of the second coil to be 1.5 to 3.0 times the ampere-turn of the first coil, the distortion can be reduced by half or more and the spot size of the deflected beam can be reduced by about half as compared to those of the prior art image pickup tube so that an image pickup tube can be obtained which minimizes distortion and improves uniformity of resolution over the scanning area.

Although in the foregoing embodiment the focus coil is so divided as to provide the asymmetrical focus magnetic field distribution, a single coil having a gradient of turns per unit axial length may of course be employed to realize the asymmetrical distribution.

We claim:

1. An image pickup tube comprising:

a tube containing at one end an electron gun for generating an electron beam;

a target provided at the other end of said tube and scanned with the electron beam;

an electrostatic deflection electrode provided on the inner surface of said tube for generating an electrostatic field which deflects the electron beam;

a mesh electrode interposed between said target and said electron gun; and a focus coil system surrounding said tube, including means for generating a magnetic field which focuses the electron beam on said target and which is distributed on the axis of said tube to have a peak of intensity which is offset toward said electron gun.

2. An image pickup tube comprising:

a tube containing at one end an electron gun for generating an electron beam;

a target provided at the other end of said tube and scanned with the electron beam;

an electrostatic deflection electrode provided on the inner surface of said tube for generating an electrostatic field which deflects the electron beam;

a mesh electrode interposed between said target and said electron gun; and a focus coil system surrounding said tube, including means for generating a magnetic field which focuses the electron beam on said target and which is distributed on the axis of said tube to have a peak of intensity which is offset toward said electron gun, wherein said focus coil system is is formed of at least first and second axially adjacent coils, a ratio $l_2/l_1$ is 0.5 to 1.0 where $l_1$ represents an axial length of said first coil close to said target and $l_2$ represents an axial length of said second sub-coil close to said electron gun, and a ratio $AT_2/AT_1$ is 1.5 to 3.0 where $AT_1$ represents an ampere-turn of said first coil and $AT_2$ represents an ampere-turn of said second coil.

3. An image pickup tube according to claim 2, wherein said electrostatic deflection electrode is twisted about the tube axis through a twist angle which ranges from 54° to 95°.

4. An image pickup tube comprising:

a tube containing at one end an electron gun for generating an electron beam;

a target provided at the other end of said tube from said electron gun so as to be scanned with the electron beam;

an electrostatic deflection electrode provided on the inner surface of said tube for generating an electrostatic field which deflects the electron beam to effect said scanning;

a mesh electrode interposed between said target and said electron gun; and a focus coil system surrounding said tube, including means for generating a magnetic field which focuses the electron beam on said target and which is distributed on the axis of said tube to have a peak of intensity that is offset toward said electron gun, said magnetic field generating means having at least two axially adjacent coils formed so that the peak of said on-axis magnetic field intensity distribution falls within a range which covers distances of 1/6 to ⅓ from the axial center of said focus coil system toward said electron gun, and where the total length of said focus coil system is normalized to 1.

5. An image pickup tube according to claim 4, wherein said electrostatic deflection electrode is twisted about the tube axis through a twist angle which ranges from 54° to 95°.

* * * * *